US010479584B2

(12) United States Patent
Resurreccion, Jr. et al.

(10) Patent No.: US 10,479,584 B2
(45) Date of Patent: Nov. 19, 2019

(54) MICROWAVE PACKAGING

(71) Applicant: Graphic Packaging International, LLC, Atlanta, GA (US)

(72) Inventors: Fermin P. Resurreccion, Jr., Thornton, CO (US); Alicia Rivera, Boulder, CO (US); Vladimir C. Martinez, Aurora, CO (US)

(73) Assignee: Graphic Packaging International, LLC, Atlanta, GA (US)

( * ) Notice: Subject to any disclaimer, the term of this patent is extended or adjusted under 35 U.S.C. 154(b) by 154 days.

(21) Appl. No.: 15/293,542

(22) Filed: Oct. 14, 2016

(65) Prior Publication Data

US 2017/0107044 A1 Apr. 20, 2017

Related U.S. Application Data

(60) Provisional application No. 62/241,974, filed on Oct. 15, 2015.

(51) Int. Cl.
*H05B 6/80* (2006.01)
*B65D 81/34* (2006.01)
(Continued)

(52) U.S. Cl.
CPC ..... *B65D 81/3453* (2013.01); *B65B 25/22* (2013.01); *B65B 61/207* (2013.01); *B65D 5/38* (2013.01); *B65D 5/48038* (2013.01); *B65D 25/06* (2013.01); *B65D 2581/3466* (2013.01); *B65D 2581/3472* (2013.01); *B65D 2581/3478* (2013.01); *B65D 2581/3479* (2013.01)

(58) Field of Classification Search
CPC ... B65B 25/22; B65B 61/207; B65D 81/3453; B65D 2581/3478; B65D 2581/3472; B65D 2581/3466; B65D 25/06; B65D 2581/3479; B65D 5/38; B65D 5/48038
USPC ..... 219/725, 728, 730, 732, 735, 734, 759, 219/766; 426/107, 234, 241, 243, 120; 99/DIG. 14
See application file for complete search history.

(56) References Cited

U.S. PATENT DOCUMENTS 1,175,512 A * 3/1916 Flemal ..... B44D 3/162 30/172
4,283,427 A 8/1981 Winters et al.
(Continued)

FOREIGN PATENT DOCUMENTS

CA 1 232 875 A 2/1988
CA 1 252 826 A 4/1989
(Continued)

OTHER PUBLICATIONS

International Search Report and Written Opinion for PCT/US2016/056989 dated Jan. 23, 2017.

*Primary Examiner* — Quang T Van
(74) *Attorney, Agent, or Firm* — Womble Bond Dickinson (US) LLP

(57) ABSTRACT

A container for heating a plurality of food items with microwave energy. The container has a tray with a sidewall extending at least partially around an interior of the tray, an insert disposed at least partially in the interior of the tray, and a plurality of receptacles at least partially defined by the insert. Each receptacle of the plurality of receptacles can be for at least partially receiving at least one food item of the plurality of food items.

41 Claims, 9 Drawing Sheets

(51) Int. Cl.

| | |
|---|---|
| ***B65D 5/64*** | (2006.01) |
| ***B65B 25/22*** | (2006.01) |
| ***B65B 61/20*** | (2006.01) |
| *B65D 25/06* | (2006.01) |
| *B65D 5/38* | (2006.01) |
| *B65D 5/49* | (2006.01) |

(56) References Cited

U.S. PATENT DOCUMENTS

| | | | | |
|---|---|---|---|---|
| 4,943,439 | A | 7/1990 | Andreas et al. | |
| 4,943,456 | A | 7/1990 | Pollart et al. | |
| 5,002,826 | A | 3/1991 | Pollart et al. | |
| 5,118,747 | A | 6/1992 | Pollart et al. | |
| 5,175,404 | A * | 12/1992 | Andreas | B65D 81/3453 219/730 |
| 5,334,820 | A * | 8/1994 | Risch | B65D 77/003 219/730 |
| 5,410,135 | A | 4/1995 | Pollart et al. | |
| 5,412,187 | A | 5/1995 | Walters et al. | |
| 5,530,231 | A | 6/1996 | Walters et al. | |
| 5,597,113 | A | 1/1997 | Bradford | |
| 5,848,470 | A * | 12/1998 | Anderson | A21C 11/00 30/277 |
| 6,204,492 | B1 | 3/2001 | Zeng et al. | |
| 6,433,322 | B2 | 8/2002 | Zeng et al. | |
| 6,552,315 | B2 | 4/2003 | Zeng et al. | |
| 6,677,563 | B2 | 1/2004 | Lai | |
| 6,717,121 | B2 | 4/2004 | Zeng et al. | |
| 6,919,547 | B2 | 7/2005 | Tsontzidis et al. | |
| 7,323,669 | B2 | 1/2008 | Robison et al. | |
| 7,351,942 | B2 | 4/2008 | Wnek et al. | |
| 7,365,292 | B2 | 4/2008 | Cole et al. | |
| 7,473,875 | B2 | 1/2009 | Fitzwater | |
| 7,476,830 | B2 | 1/2009 | Middleton et al. | |
| 7,514,659 | B2 | 4/2009 | Lafferty | |
| 7,770,751 | B2 * | 8/2010 | Henry | A21B 3/135 220/507 |
| 7,868,274 | B2 | 1/2011 | Bohme et al. | |
| 7,982,168 | B2 | 7/2011 | Middleton et al. | |
| 8,158,914 | B2 | 4/2012 | Wnek et al. | |
| 8,217,325 | B2 | 7/2012 | Russell et al. | |
| 2006/0011620 | A1 | 1/2006 | Tsontzidis et al. | |
| 2006/0096978 | A1 | 5/2006 | Lafferty et al. | |
| 2006/0138128 | A1 | 6/2006 | Cole et al. | |
| 2006/0272461 | A1 * | 12/2006 | Atwater | A21C 11/106 83/13 |
| 2007/0023426 | A1 | 2/2007 | Russell et al. | |
| 2007/0102424 | A1 | 5/2007 | Keefe | |
| 2007/0194029 | A1 | 8/2007 | Middleton et al. | |
| 2007/0215611 | A1 | 9/2007 | O'Hagan et al. | |
| 2007/0262487 | A1 | 11/2007 | O'Hagan et al. | |
| 2008/0035634 | A1 | 2/2008 | Zeng et al. | |
| 2011/0065556 | A1 | 3/2011 | Middleton et al. | |
| 2011/0168698 | A1 | 7/2011 | Ford et al. | |
| 2011/0256284 | A1 | 10/2011 | Jackson et al. | |
| 2012/0292813 | A1 | 11/2012 | Middleton et al. | |

FOREIGN PATENT DOCUMENTS

| | | | |
|---|---|---|---|
| CA | 1 304 044 | C | 6/1992 |
| CA | 1 305 533 | C | 7/1992 |
| CA | 2 002 241 | C | 3/1993 |
| CA | 1 329 794 | C | 5/1994 |
| CA | 1 333 493 | C | 12/1994 |
| CA | 2 093 246 | C | 8/1996 |
| CA | 2 444 820 | A1 | 3/1998 |
| CA | 2 250 434 | C | 11/2002 |
| CA | 2 140 518 | C | 12/2003 |
| CA | 2 264 121 | C | 7/2004 |
| CA | 2 586 472 | A1 | 5/2006 |
| CA | 2 434 901 | C | 6/2006 |
| CA | 2 334 690 | C | 11/2006 |
| CA | 2 185 179 | C | 4/2007 |
| CA | 2 564 627 | C | 3/2008 |
| CA | 2 599 145 | C | 5/2009 |
| DE | 697 34 328 | T2 | 7/2006 |
| EP | 1 040 054 | B1 | 3/2005 |
| EP | 0 958 196 | B1 | 12/2005 |
| EP | 1 796 988 | B1 | 2/2012 |
| JP | 2007-204049 | A | 8/2007 |
| WO | WO 2003/053106 | A1 | 6/2003 |
| WO | WO 2004/033324 | A1 | 4/2004 |
| WO | WO 2006/110685 | A2 | 10/2006 |
| WO | WO 2007/016131 | A1 | 2/2007 |
| WO | WO 2007/021439 | A2 | 2/2007 |
| WO | WO 2007/103428 | A2 | 9/2007 |
| WO | WO 2007/127371 | A2 | 11/2007 |

* cited by examiner

MICROWAVE PACKAGING

CROSS-REFERENCE TO RELATED APPLICATIONS

This application claims the benefit of U.S. Provisional Patent Application No. 62/241,974, filed Oct. 15, 2015.

INCORPORATION BY REFERENCE

The disclosure of U.S. Provisional Patent Application No. 62/241,974, filed Oct. 15, 2015, is hereby incorporated by reference as if presented herein in its entirety and is incorporated by reference for all purposes.

BACKGROUND OF THE DISCLOSURE

The present disclosure relates to blanks, containers, trays, constructs, and various features to facilitate forming a container.

SUMMARY OF THE DISCLOSURE

In general, one aspect of the disclosure is generally directed to a container for heating a plurality of food items with microwave energy. The container can comprise a tray comprising a sidewall extending at least partially around an interior of the tray, an insert disposed at least partially in the interior of the tray, and a plurality of receptacles at least partially defined by the insert. Each receptacle of the plurality of receptacles can be for at least partially receiving at least one food item of the plurality of food items.

In another aspect, the present disclosure is generally directed to an insert for being disposed in an interior of a tray to form a container for heating a plurality of food items with microwave energy. The insert can comprise a plurality of lateral ribs and a plurality of longitudinal ribs. Each lateral rib of the plurality of lateral ribs can engage each longitudinal rib of the plurality of longitudinal ribs. A plurality of receptacles can be at least partially defined by at least one of the lateral ribs of the plurality of lateral ribs and at least one of the longitudinal ribs of the plurality of longitudinal ribs. Each receptacle of the plurality of receptacles can be for receiving at least one food item of the plurality of food items.

In another aspect, the present disclosure is generally directed to a method of forming a package. The method can comprise obtaining a tray comprising a sidewall extending at least partially around an interior of the tray, and at least partially forming a container by positioning an insert at least partially in the interior of the tray. The insert can at least partially define a plurality of receptacles. The method further can comprise inserting a plurality of food items into the container by positioning at least one food item of the plurality of food items at least partially into each receptacle of the plurality of receptacles.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure relates generally to various aspects of containers, constructs, trays, inserts, materials, packages, elements, and articles, and methods of making such containers, constructs, trays, inserts, materials, packages, elements, and articles. Although several different aspects, implementations, and embodiments are disclosed, numerous interrelationships between, combinations thereof, and modifications of the various aspects, implementations, and embodiments are contemplated hereby. In one illustrated embodiment, the present disclosure relates to a container or tray for holding, heating, and/or cooking food items or various other articles. However, in other embodiments, the container or tray can be used to form other non-food containing articles or may be used for refrigerating or other uses.

Figure 1A:
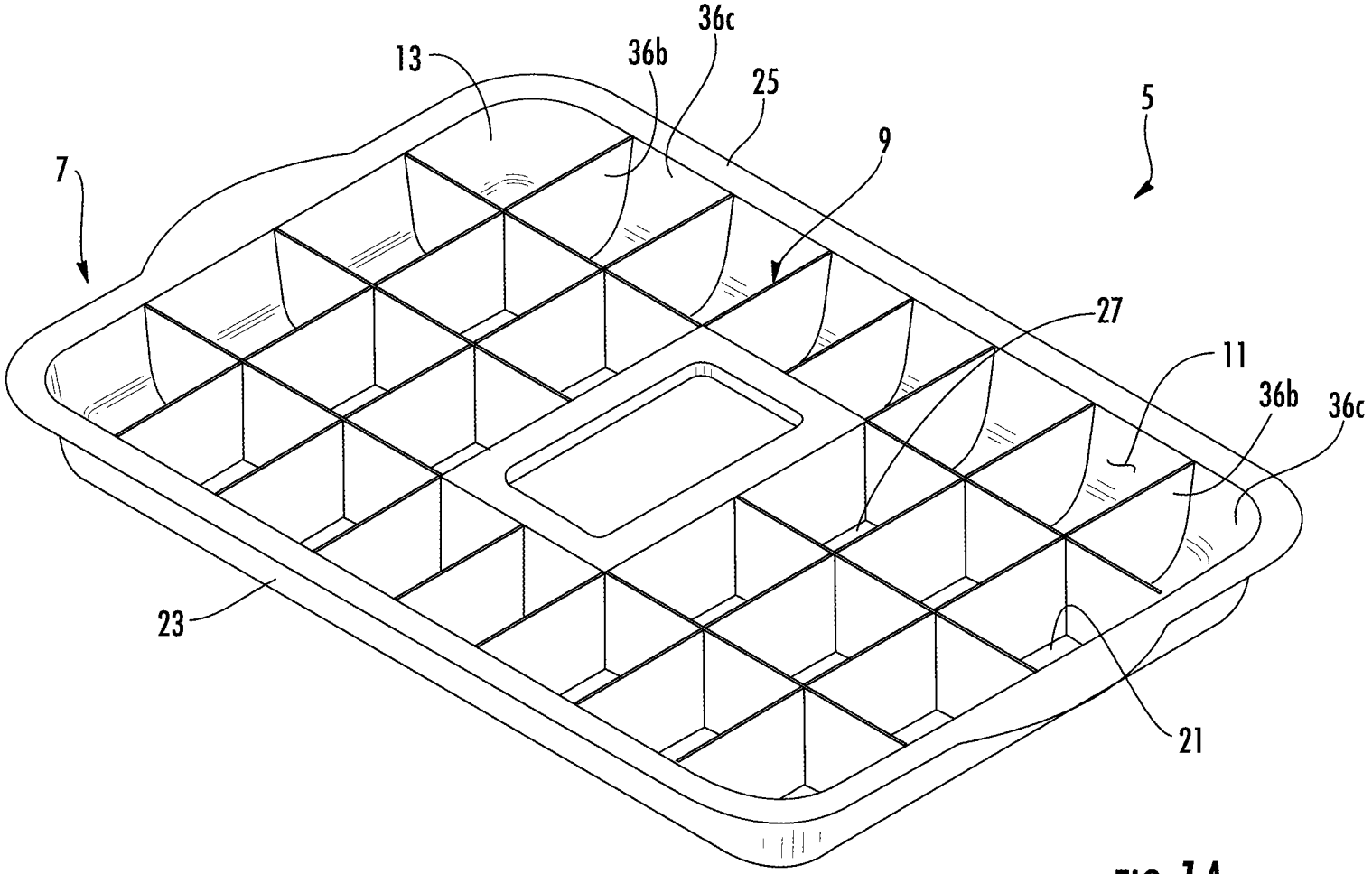
FIG. 1A is a schematic perspective view of a container according to a first embodiment of the disclosure.
Figure 1B:
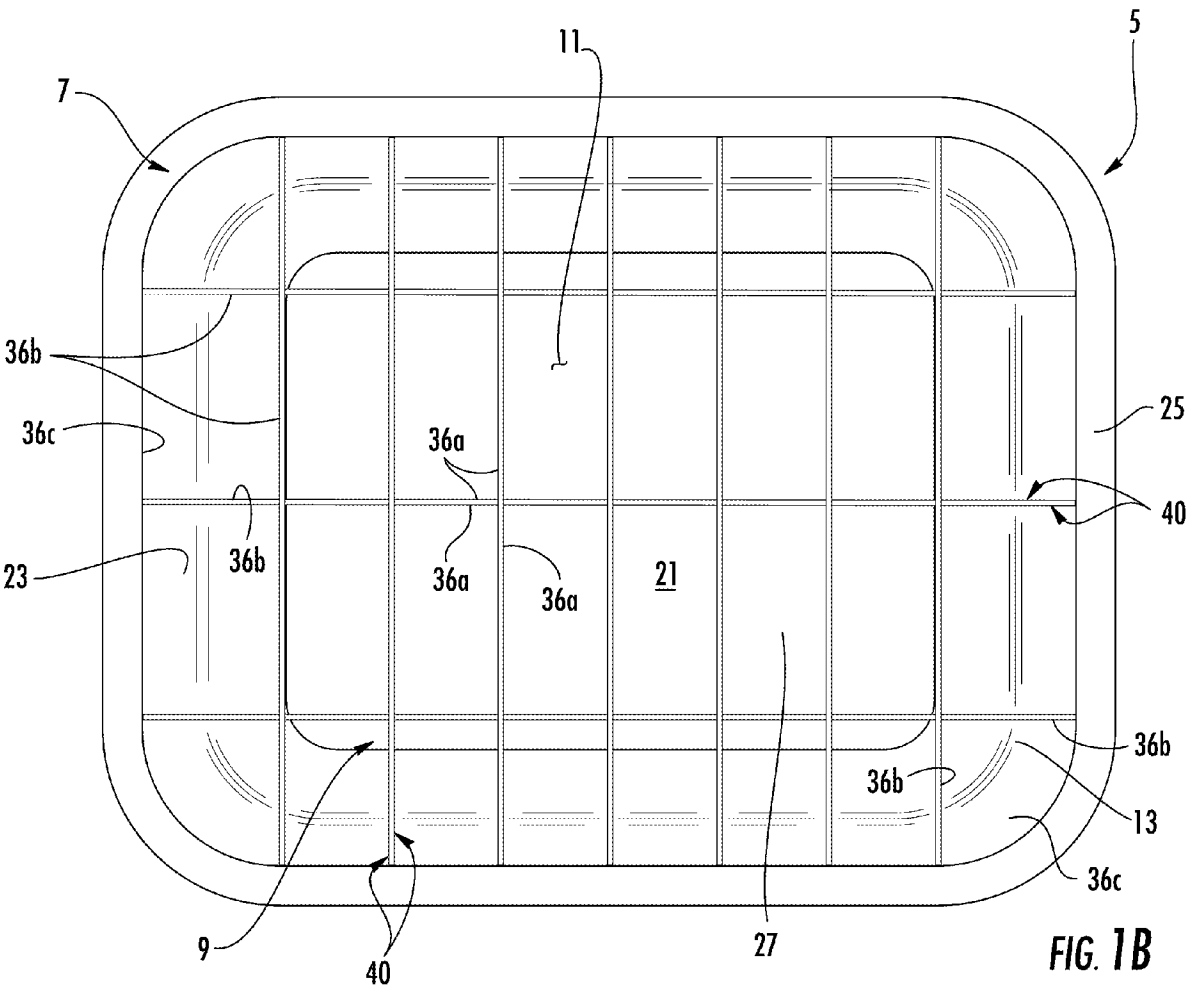
FIG. 1B is a schematic top view of the container of FIG. 1A.

FIGS. 1A and 1B illustrate a container 5 with a generally rectangular-shaped receptacle or tray 7 and a grid-like insert 9 according to a first embodiment of the disclosure. In the illustrated embodiment, the insert 9 is removably disposed in an interior 11 of the tray 7. Alternatively, the insert 9 could be glued or otherwise secured to an interior surface 13 of the tray 7. The container could be otherwise shaped, arranged, positioned, and/or configured without departing from the disclosure.

As shown in FIGS. 1A-1C, the tray 7 generally includes a bottom wall 21, a sidewall 23 with curved corners, and a flange 25 extending outwardly from a top end of the sidewall 23. The tray 7 can be curved at the transition between the bottom wall 21 and the sidewall 23. The tray 7 can be press formed and/or erected from a blank (not shown). It is understood that the blank can be press-formed into the tray 7 by a forming tool (not shown) and/or through a one-step or multi-step forming process by which the blank is cut from a supply stock and press-formed into the tray 7 by any suitable forming tool assembly. Alternatively, the tray 7 could be erected from one or more blanks (not shown) such as by folding and/or gluing different aspects of the blank(s) to form the tray. Also, the tray 7 could be omitted and/or could be alternatively formed without departing from the scope of this disclosure.

The tray 7 can be formed from a single layer, such as, but not limited to, paperboard, cardboard, paper, or a polymeric sheet. Alternatively, the tray 5 can be formed from more than one layer (e.g., a laminate). In accordance with the exemplary embodiments of the present disclosure, a laminate can include a lamination layer mounted on a substrate or base layer (e.g., a polymer lamination layer on a paperboard substrate). In one embodiment, the lamination layer could be disposed on an interior side of the substrate. Alternatively, the tray 7 could be formed of any suitable material or suitable combination of materials. For example, the tray 7 could include a molded polymer. In the illustrated embodiment, the tray 7 includes a susceptor 27 disposed (e.g., coated and/or adhered) on the interior surface 13 of at least the bottom wall 21. The tray 7 could be otherwise shaped, arranged, positioned, and/or configured without departing from the disclosure. For example, the sidewall 23 could have any suitable number of corners or the corners could be omitted and the sidewall 23 could be circular or elliptic in alternative embodiments.

Figure 2A:
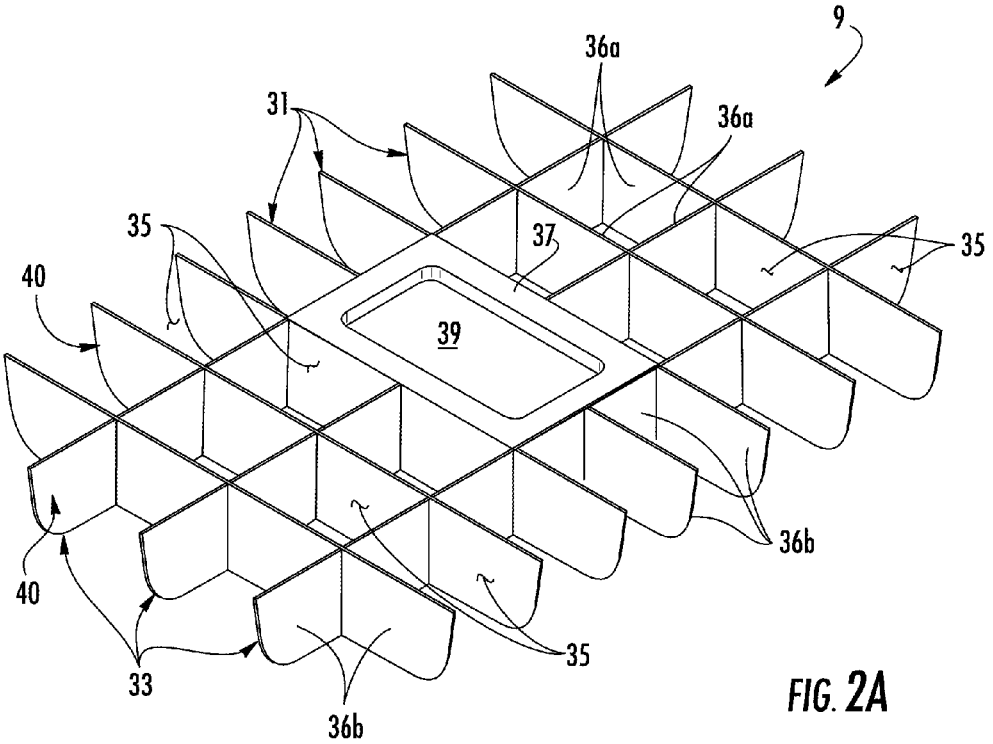
FIG. 2A is a schematic perspective view of an insert of the container of FIG. 1.
Figure 2B:
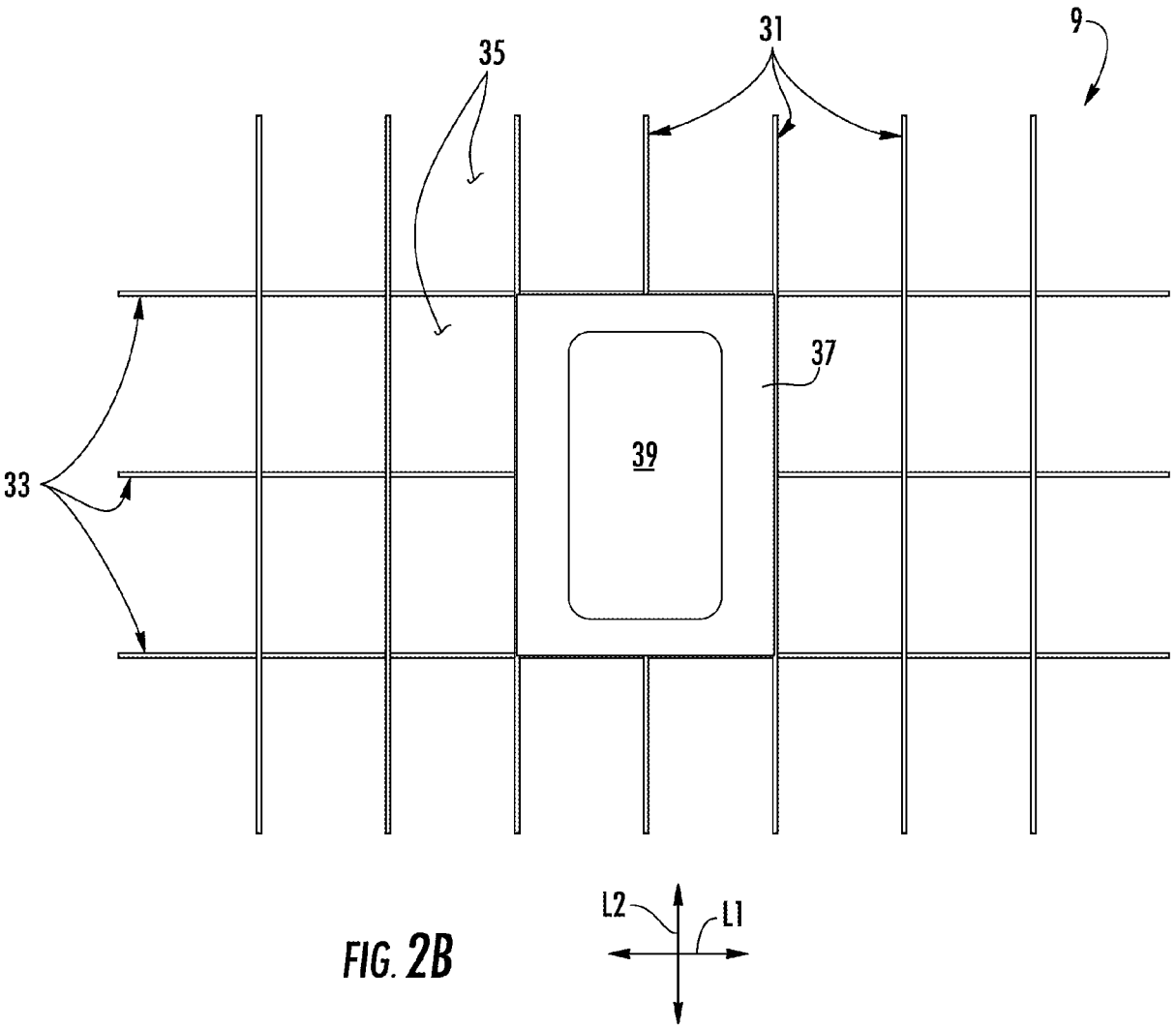
FIG. 2B is a schematic top view of the insert of FIG. 2A.

As shown in FIGS. 2A and 2B, the insert 9 includes seven lateral ribs 31 (FIG. 3A) engaged with three longitudinal ribs 33 (FIG. 3B) so that the ribs form the respective sides of a plurality of receptacles 35. In the illustrated embodiment, the insert 9 defines interior receptacles and marginal receptacles. Each of the interior receptacles has four sides 36*a* defined by portions of respective ribs 31, 33. In particular, each interior receptacle can have two opposing sides defined by respective portions of two adjacent lateral ribs 31 and two opposing sides defined by respective portions of two adjacent longitudinal ribs 33. As shown in FIGS. 1A-2B, the marginal receptacles can have three sides 36*b* defined by portions of the ribs 31, 33 and one side 36*c* defined by a portion of the sidewall 23 or two sides 36*b* defined by portions of the ribs 31, 33 and a curved side 36*c* defined by a respective corner of the sidewall 23. In particular, each marginal receptacle can include two opposing sides defined by the respective end portions of two adjacent lateral ribs 31, a side defined by a portion of one of the longitudinal ribs 33, and a side defined by a portion of the sidewall 23; two opposing sides defined by the respective end portions of two adjacent longitudinal ribs 33, a side defined by a portion of one of the lateral ribs 31, and a side defined by a portion of the sidewall 23; or two sides defined by the respective end portions of one of the lateral ribs 31 and one of the longitudinal ribs 33 and two sides defined by a respective corner of the sidewall 23. As shown in FIGS. 1A and 1B, the bottom wall 21 of the tray 7 can form the bottom of the receptacles 35 when the container 5 is assembled.

As shown in FIGS. 2A and 2B, the insert 9 can include a center panel or central panel 37 that at least partially extends over and at least partially covers (e.g., blocks) four of the receptacles 35 in the center of the insert 9. In the illustrated embodiment, the central panel 37 engages top edges of three lateral ribs 31 and three longitudinal ribs 33 in the central portion of the insert 9, and, in one embodiment, the central panel 37 can be adhered to and/or integral with one or more of the ribs 31, 33. One or more of the covered portions of the ribs 31, 33 can be recessed to at least partially accommodate the central panel 37 so that the upper surface of the central panel can be coplanar with the upper edges of the ribs. As shown in FIGS. 1A-3D, the center panel 37 can include a recess 39 for holding a secondary food item (e.g., dipping sauce, spices, other flavorings, etc.) and/or a secondary container for holding a secondary food item. Such a secondary food item (not shown) can be a food item that does not need to be heated as much as the primary food item and/or that is more easily heated by microwave energy than the primary food item since the central portion of the container 5 will generally be exposed to less microwave energy than a remainder of the container due to the electromagnetic field distribution in the container. The insert 9 could be otherwise shaped, arranged, positioned, and/or configured without departing from the disclosure. For example, the central panel 37 could be omitted, could be a different size and/or shape (e.g., to at least partially cover more or fewer of the receptacles 35), and/or could be otherwise positioned in the insert 9 (e.g., not aligned with the center of the insert). Additionally, the recess 39 could be omitted or could have a different size, position, and/or shape and/or the central panel 37 could include any suitable number of recesses. Further, the insert could extend over a different number of lateral ribs 31 and/or longitudinal ribs 33.

Figure 7:
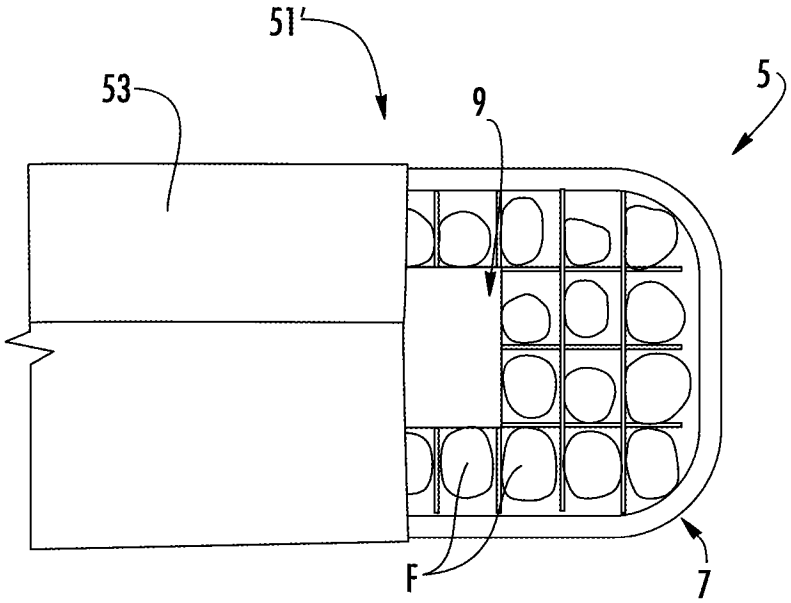
FIG. 7 is a schematic top view of a package formed from the container of FIGS. 1A and 1B with food products and a susceptor cover according to an alternative embodiment of the disclosure.
Figure 6:
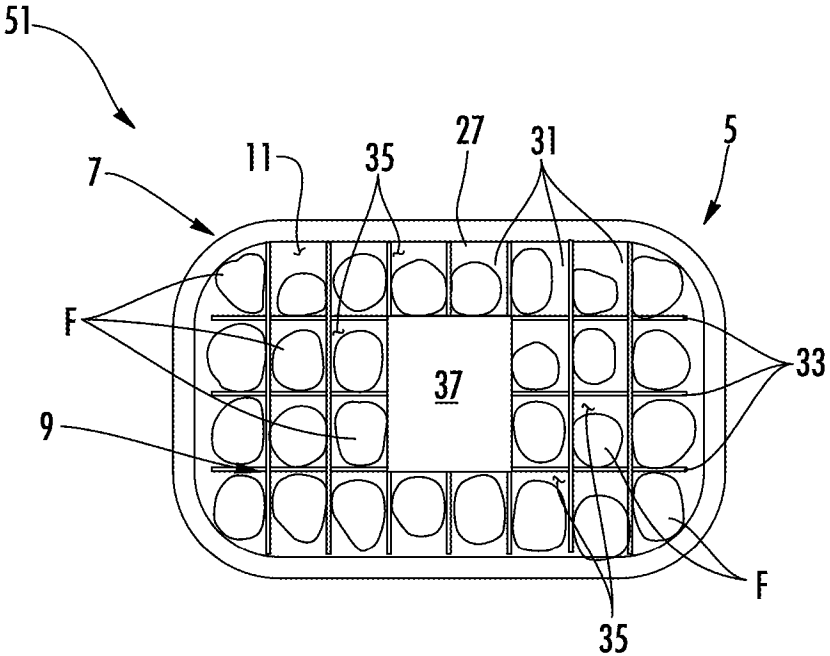
FIG. 6 is a schematic top view of a package formed from the container of FIGS. 1A and 1B with food products according to the first embodiment of the disclosure.

As shown in FIG. 2B, the seven lateral ribs 31 can extend in a lateral direction L2 and can be spaced apart from one another in a longitudinal direction L1. Similarly, the three longitudinal ribs 33 can extend in the longitudinal direction L1 and can be spaced apart from one another along the lateral direction L2. Accordingly, the insert 9 can form thirty two receptacles 35 in the tray 7 when the container 5 is formed (FIGS. 1A, 1B, 6, and 7) and one or more food items F (e.g., small potatoes as shown in FIGS. 6 and 7) can be disposed in each of the receptacles 35. Alternatively, the insert 9 may be sized and shaped to hold food items of a different or same quantity in more than one layer and/or in different row/column arrangements, or just a single food item. For example, the insert 9 could have alternative receptacle 35 arrangements with different numbers of longitudinal ribs 33 and/or lateral ribs 31 (e.g., 1×6, 2×6, 4×3, 3×8, 2×2, 3×4, 2×9, 3×6, etc.). In one embodiment, the lateral ribs 31 and/or the longitudinal ribs 33 could be longer to accommodate additional longitudinal ribs 33 and/or lateral ribs 31 and/or the spacing between the lateral ribs 31 and/or the longitudinal ribs 33 could be reduced to accommodate additional longitudinal ribs 33 and/or lateral ribs 31. In one embodiment, the spacing between the ribs 31, 33 could be selected for forming receptacles 35 that are appropriately sized to receive a particular food item F.

Figure 3A:
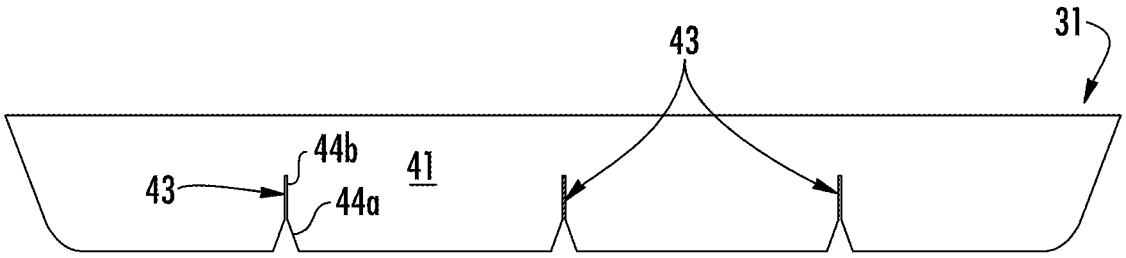
FIGS. 3A and 3B are schematic side views of respective ribs of the insert of FIGS. 2A and 2B.
Figure 3B:
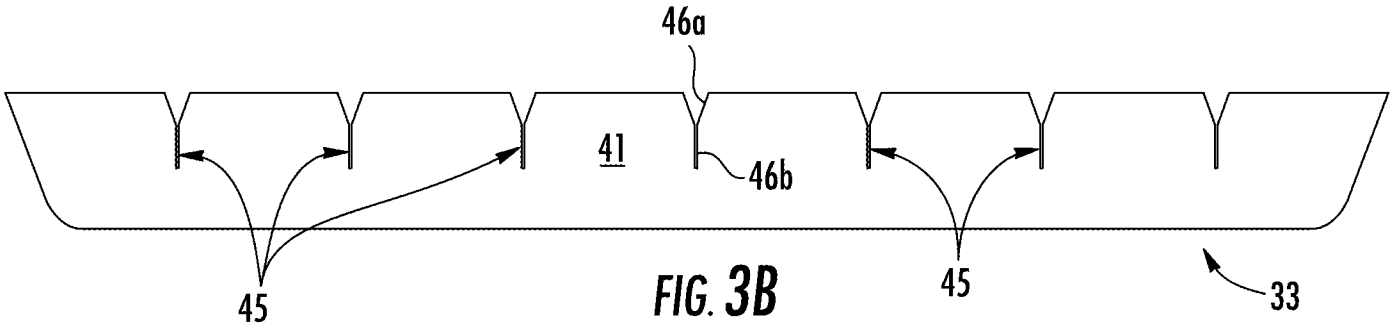

As shown in FIGS. 3A and 3B, each of the ribs 31, 33 can have a generally horizontal top edge and bottom edge and generally oblique side edges corresponding to the oblique sidewall 23 of the tray 7. In the illustrated embodiment, each of the ribs 31, 33 can include two opposing faces 40, and each face 40 of each of the ribs 31, 33 can include a microwave energy interactive material (e.g., susceptor) 41 so that at least the sides 36*a*, 36*b* of each of the receptacles 35 defined by the ribs 31, 33 has a susceptor when the insert 9 is assembled (FIGS. 2A, 2B, 5A, and 5B). In one embodiment, the sides 36*c* defined by the sidewall 23 of the tray 7 can include a susceptor.

As shown in FIG. 3A, each of the lateral ribs 31 has three notches 43 in communication with the bottom edge of the respective rib. Similarly, as shown in FIG. 4B, each of the longitudinal ribs 33 has seven notches 45 in communication with the top edge of the respective rib. Each of the notches 43, 45 can be wider at the respective edge of the respective rib 31, 33 and can taper to a slit in the interior of the respective rib (e.g., each notch 43 has a tapered portion 44*a* extending from the bottom edge of the respective lateral rib 31 and a slit portion 44*b* extending from the respective tapered portion 44*a*, and each notch 45 has a tapered portion 46*a* extending from the bottom edge of the respective longitudinal rib 33 and a slit portion 46*b* extending from the respective tapered portion 46*a*). In the illustrated embodiment, the size of the receptacles 35 in the lateral direction L2 and the longitudinal direction L1 can be controlled by the spacing between the respective notches 43, 45. In one embodiment, the ribs 31, 33 can be cut into individual pieces from a roll stack laminated with susceptor and/or with a predefined focus susceptor on either or both sides of the roll stack. In one exemplary embodiment, each rib 31, 33 can comprise 24ga paperboard laminate with 48ga susceptor film on each side. Any of the ribs 31, 33 could be omitted or could be otherwise shaped, arranged, positioned, and/or configured without departing from the disclosure. For example one or more of the ribs could have ends with any suitable shapes (e.g., to accommodate a sidewall and/or a bottom wall of a tray with different shapes).

Figure 4:
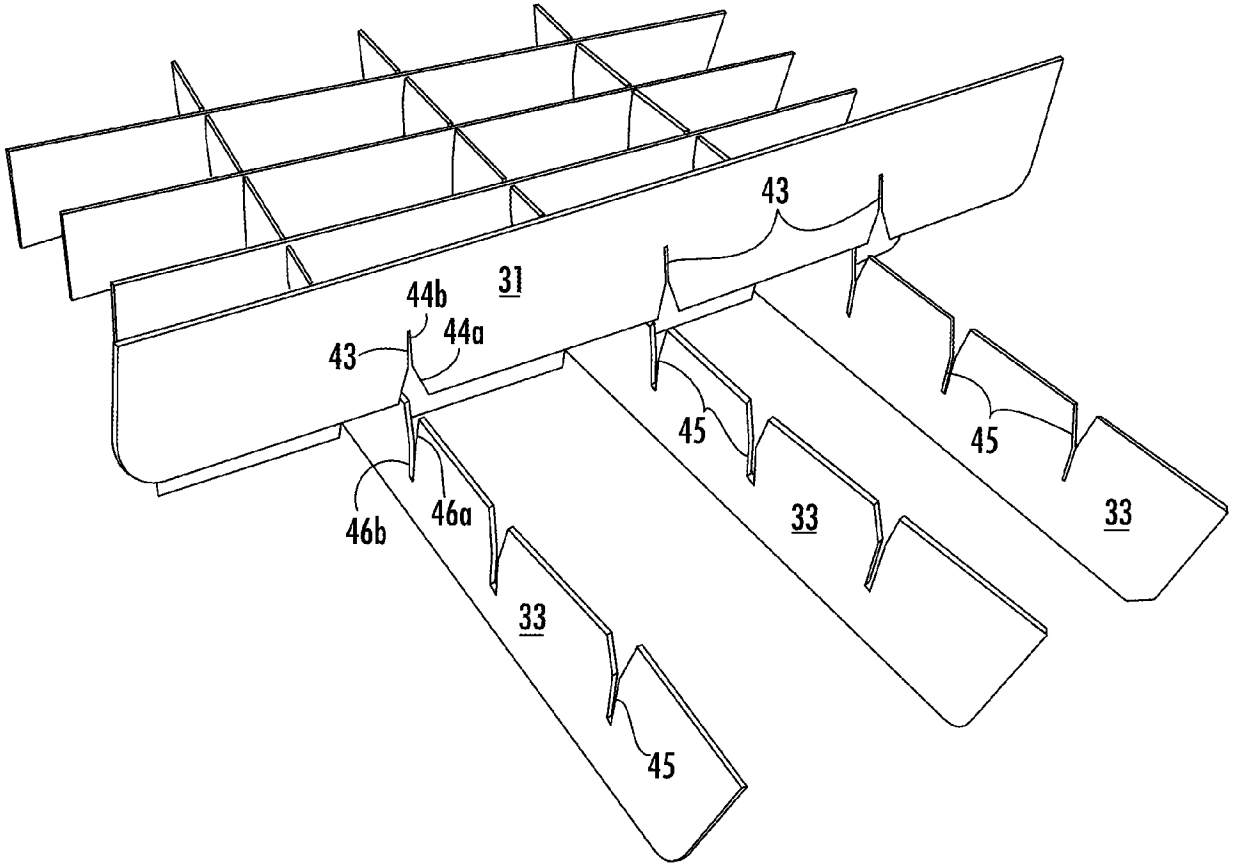
FIG. 4 is a schematic perspective view showing the erection of the insert of FIGS. 2A and 2B from the ribs of FIGS. 3A and 3B according to the first embodiment of the disclosure.

As shown in FIG. 4, the insert 9 can be assembled by aligning each of the notches 43 in a lateral rib 31 with respective notches 45 in respective longitudinal ribs 33 and moving the ribs 31, 33 together so that notches 43, 45 respectively engage one another (e.g., so that a slit portion 44*b* of a notch 43 engages a slit portion 46*b* of a respective notch 45). Accordingly, the ribs 31, 33 are interlocked at the notches 43, 45 and generally support one another. Subsequently, the remaining lateral ribs 31 are assembled onto the longitudinal ribs 33 in the same or a similar manner. In the illustrated embodiment, the ribs 31, 33 are generally the same height so that the top edges of the ribs are all generally in a plane and the bottom edges of the ribs 31, 33 are all generally in another plane. Alternatively, one or more of the ribs 31, 33 could be taller or shorter than the other ribs 31, 33. For example, some or all of the lateral ribs 31 could be shorter than the longitudinal ribs 33. The ribs 31, 33 could be assembled by other assembly steps and/or in a different order without departing from the disclosure.

As shown in FIGS. 2A and 2B, the central panel 37 can be added to the assembled ribs 31, 33 such as by gluing the center panel 37 to the lateral ribs 31 and/or the longitudinal ribs 33. In one embodiment, one or more of the ribs 31, 33 can be recessed to accommodate the central panel 37 and/or the recess 39 in the central panel 37. The insert 9 could be otherwise assembled without departing from the disclosure. For example, the central panel 37 could be omitted.

Figure 5A:
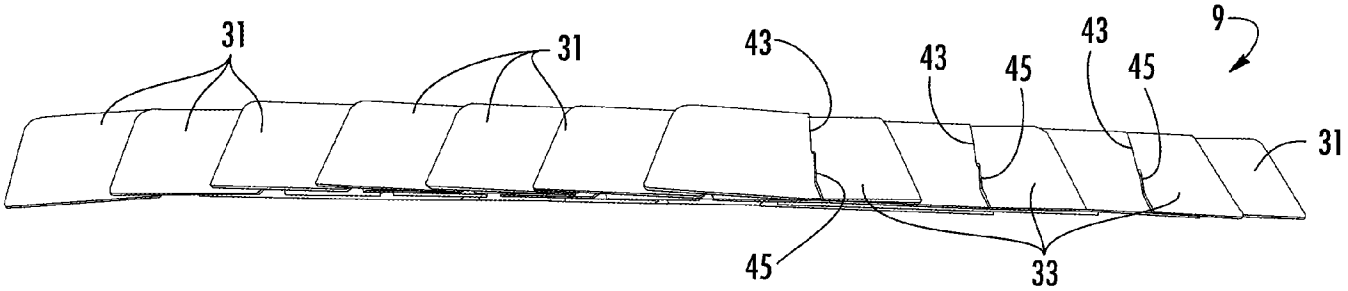
FIG. 5A is a schematic perspective view of the insert of FIGS. 2A and 2B in a collapsed configuration according to the first embodiment of the disclosure.
Figure 5B:
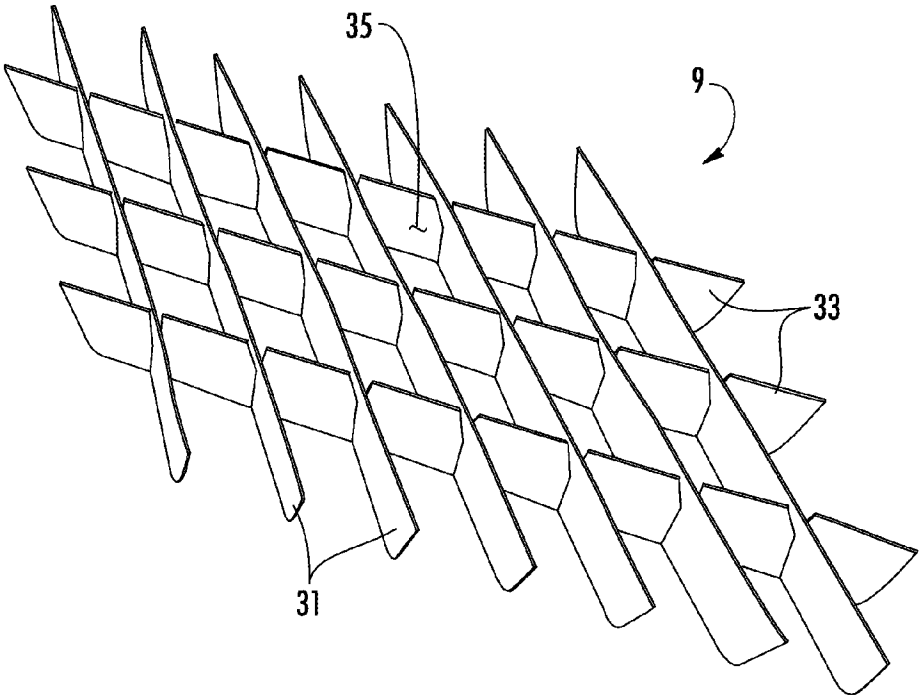
FIG. 5B schematically shows a transition of the insert of FIGS. 2A and 2B between the collapsed configuration of FIG. 5A and the erected configuration of FIG. 2A according to the first embodiment of the disclosure.

As shown in FIGS. 5A and 5B, the insert 9 (e.g., with the central panel 37 omitted) can be transitioned between a collapsed configuration (FIG. 5A) to the erected configuration (FIGS. 2A and 2B) with an intermediate configuration (FIG. 5B) therebetween. In one embodiment, the erected configuration of the insert 9 can have generally rectangular receptacles 35 with lateral ribs 31 that are generally perpendicular to the longitudinal ribs 33. The insert 9 can be arranged in the collapsed or flattened configuration shown in FIG. 5A for storage and/or transportation of the insert for example. In one embodiment, the insert 9 can be transitioned to the collapsed configuration from the erected configuration by pushing on opposing corners of the erected insert 9. In one exemplary embodiment, the pushing on the opposing corners of the insert 9 can cause the ribs 31, 33 to pivot with respect to one another at the respective interconnections of the notches 43, 45 (e.g., at the respective intersections of the ribs) so that the ribs 31, 33 are no longer generally perpendicular to one another (e.g., as shown in FIG. 5B). Continued pushing on the opposing corners of the insert 9 can cause the ribs 31, 33 to come into face-to-face contact with adjacent ribs 31, 33 so that the insert 9 is generally flattened (FIG. 5A). The insert 9 can be transitioned from the collapsed configuration of FIG. 5A to the erected configuration of FIGS. 2A and 2B by pulling on the opposing corners of the insert that are disposed along the sides of the flattened insert, or by pushing on the ends of the flattened insert, which ends are opposing corners of the erected insert. The insert 9 could be otherwise transitioned between a flattened or collapsed configuration and an erected configuration and/or between any suitable configurations without departing from the disclosure.

As shown in FIG. 6, a package 51 can include the tray 7 and the insert 9 of the container 5 and a food item F (e.g., potatoes) disposed in each of the receptacles 35 of the insert 9 in the interior 11 of the tray 7. Since the tray has a susceptor 27 on the bottom wall 21, and the ribs 31, 33 have susceptors 41 on their faces 40, each food item F can be in contact with and/or in close proximity to a susceptor 27, 41 on multiple sides. Accordingly, the insert 9 can help increase and/or optimize the amount of surface area of the food items F that is in contact with a susceptor, which can help with browning and/or crisping additional surface of the food items F. Additionally, as shown in FIG. 6, the food items F are compartmentalized by the insert so that the food items F are not on top of one another or in contact with one another. In one embodiment, the compartmentalization of the food items F can help retain the food items F in areas of the container 5 where the heat and/or microwave energy is generally evenly distributed (e.g., the food items F are retained outside the area covered by the center panel 37 where the microwave energy can be lower due to the electromagnetic field distribution in the container 5 when exposed to microwave energy).

The package 51 can also include a cover or film (not shown), such as a heat sealable polyethylene film, attached to the flange 25, for example. In an alternative embodiment shown in for example in FIG. 7, a sleeve or cover 53 with a susceptor layer (not shown) can cover or at least partially cover the container 5 to form a package 51'. In one embodiment, a cover with a susceptor can shield the interior of the container 5 from some or all of the microwave energy to which the package is exposed.

In the illustrated embodiment, when the package 51 is exposed to microwave energy (e.g., in a microwave oven), the food items F can be generally evenly heated directly by the microwave energy in the interior 11 of the container 5 since the food items F are evenly distributed in an area of the container 5 that has generally even electromagnetic field distribution (e.g., as compared to the interior portion covered by the center panel 37). Additionally, since multiple sides of the food items F are in contact with and/or close proximity to the susceptors 27, 41, the food items F can be heated, browned, and/or crisped by the susceptors 27, 41. In one embodiment, the additional paperboard provided by the insert 9 also can help absorb moisture (e.g., from condensation) that would otherwise collect on the bottom wall of the tray 7 and cause at least a portion of the food items F to become soggy. Accordingly, heating the package 51 in a microwave oven can result in generally evenly heated food items F with a desirably soft and moist interior and crispy and/or drier exterior (e.g., for potatoes). In comparison, in one experimental example, food items F (potatoes) were heated in the tray 7 without the insert 9. The result was a much larger temperature gradient between different potatoes. Longer heating times without the insert 9 only increased the temperature gradient between individual potatoes and did not improve the heating of the potatoes. In contrast, as noted above, heating the potatoes with the insert 9 in the tray 7 resulted in a low temperature gradient between the different potatoes.

Figure 8A:
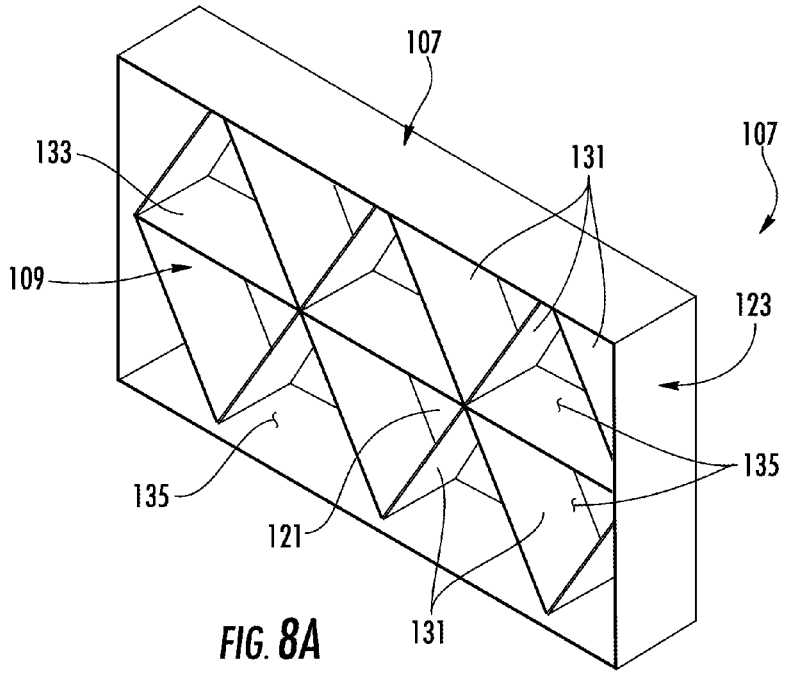
FIG. 8A is a schematic perspective view of a container according to a second embodiment of the disclosure.
Figure 8B:
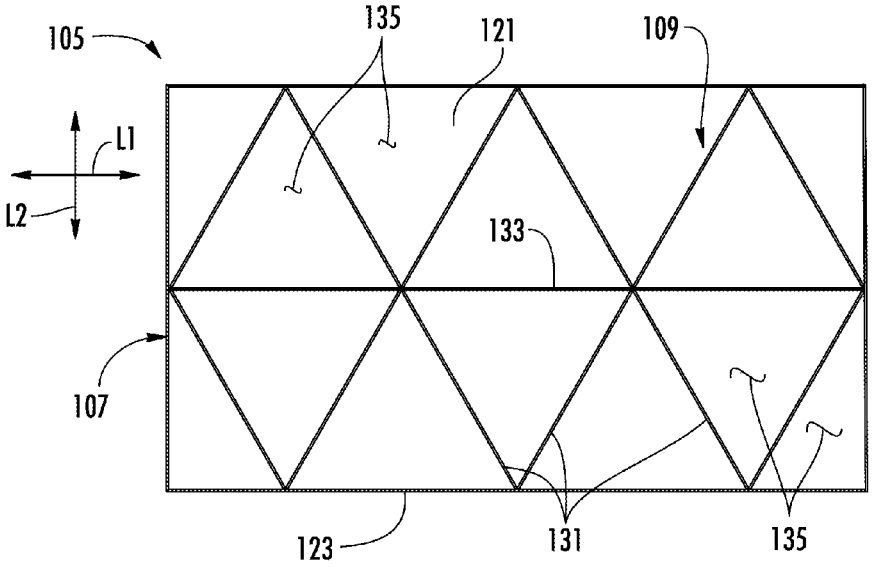
FIG. 8B is a schematic top view of the container of FIG. 8A.

FIGS. 8A and 8B are views of a container 105 according to a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIG. 8A, the container 105 includes a generally rectangular tray 107 with square corners. Alternatively, the tray 107 could have rounded corners or could be any suitable shape. The container 105 also includes an insert 109 with triangular receptacles 135. The receptacles 135 can be formed by oblique sidewalls 131, a longitudinal sidewall 133, and the sidewalls 123 of the tray 107. In an alternative embodiment, the insert 109 could include more than one longitudinal sidewall 133. The sidewalls 131, 133 could be similar to the ribs 31, 33 in the first embodiment. Alternatively, the sidewalls could be formed by any suitable features. Any or all of the surfaces of the sidewalls 131, 133 can include a susceptor film or other microwave energy interactive element thereon. Additionally, the bottom wall 121 and/or the sidewall 123 of the tray 107 can include a susceptor film or other microwave energy interactive element. The container 105, including the tray 107 and/or the insert 109, could be otherwise shaped, arranged, positioned, and/or configured without departing from the disclosure. For example, the receptacles 135 could have any suitable shape (e.g., in one embodiment, the receptacles could be hexagons such as for food items with circular or cylindrical geometries).

Any of the features of the various embodiments of the disclosure can be combined with, replaced by, or otherwise configured with other features of other embodiments of the disclosure without departing from the scope of this disclosure.

Optionally, one or more portions of the blank or other constructs described herein or contemplated hereby may be coated with varnish, clay, or other materials, either alone or in combination. The coating may then be printed over with product advertising or other information or images. The blanks or other constructs also may be selectively coated and/or printed so that less than the entire surface area of the blank or substantially the entire surface area of the blank may be coated and/or printed.

As noted above with reference to the susceptors 27, 41, any of the blanks, containers, inserts, or other constructs of this disclosure may optionally include one or more features that alter the effect of microwave energy during the heating or cooking of a food item that is associated with the tray or other construct. For example, the blank, tray, container, or other construct may be formed at least partially from one or more microwave energy interactive elements (hereinafter sometimes referred to as "microwave interactive elements") that promote heating, browning and/or crisping of a particular area of the food item, shield a particular area of the food item from microwave energy to prevent overcooking thereof, or transmit microwave energy towards or away from a particular area of the food item. Each microwave interactive element comprises one or more microwave energy interactive materials or segments arranged in a particular configuration to absorb microwave energy, transmit microwave energy, reflect microwave energy, or direct microwave energy, as needed or desired for a particular construct and food item.

In the case of a susceptor or shield, the microwave energy interactive material may comprise an electroconductive or semiconductive material, for example, a vacuum deposited metal or metal alloy, or a metallic ink, an organic ink, an inorganic ink, a metallic paste, an organic paste, an inorganic paste, or any combination thereof. Examples of metals and metal alloys that may be suitable include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide, for example, oxides of aluminum, iron, and tin, optionally used in conjunction with an electrically conductive material. Another metal oxide that may be suitable is indium tin oxide (ITO). ITO has a more uniform crystal structure and, therefore, is clear at most coating thicknesses.

Alternatively still, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

In other embodiments, the microwave energy interactive material may be carbon-based, for example, as disclosed in U.S. Pat. Nos. 4,943,456, 5,002,826, 5,118,747, and 5,410,135.

In still other embodiments, the microwave energy interactive material may interact with the magnetic portion of the electromagnetic energy in the microwave oven. Correctly chosen materials of this type can self-limit based on the loss of interaction when the Curie temperature of the material is reached. An example of such an interactive coating is described in U.S. Pat. No. 4,283,427.

The use of other microwave energy interactive elements is also contemplated. In one example, the microwave energy interactive element may comprise a foil or high optical density evaporated material having a thickness sufficient to reflect a substantial portion of impinging microwave energy. Such elements typically are formed from a conductive, reflective metal or metal alloy, for example, aluminum, copper, or stainless steel, in the form of a solid "patch" generally having a thickness of from about 0.000285 inches to about 0.005 inches, for example, from about 0.0003 inches to about 0.003 inches. Other such elements may have a thickness of from about 0.00035 inches to about 0.002 inches, for example, 0.0016 inches.

In some cases, microwave energy reflecting (or reflective) elements may be used as shielding elements where the food item is prone to scorching or drying out during heating. In other cases, smaller microwave energy reflecting elements may be used to diffuse or lessen the intensity of microwave energy. One example of a material utilizing such microwave energy reflecting elements is commercially available from Graphic Packaging International, Inc. (Marietta, Ga.) under the trade name MicroRite® packaging material. In other examples, a plurality of microwave energy reflecting elements may be arranged to form a microwave energy distributing element to direct microwave energy to specific areas of the food item. If desired, the loops may be of a length that causes microwave energy to resonate, thereby enhancing the distribution effect. Microwave energy distributing elements are described in U.S. Pat. Nos. 6,204,492, 6,433,322, 6,552,315, and 6,677,563, each of which is incorporated by reference in its entirety.

If desired, any of the numerous microwave energy interactive elements described herein or contemplated hereby may be substantially continuous, that is, without substantial breaks or interruptions, or may be discontinuous, for example, by including one or more breaks or apertures that transmit microwave energy. The breaks or apertures may extend through the entire structure, or only through one or more layers. The number, shape, size, and positioning of such breaks or apertures may vary for a particular application depending on the type of construct being formed, the food item to be heated therein or thereon, the desired degree of heating, browning, and/or crisping, whether direct exposure to microwave energy is needed or desired to attain uniform heating of the food item, the need for regulating the change in temperature of the food item through direct heating, and whether and to what extent there is a need for venting.

By way of illustration, a microwave energy interactive element may include one or more transparent areas to effect dielectric heating of the food item. However, where the microwave energy interactive element comprises a susceptor, such apertures decrease the total microwave energy interactive area, and therefore, decrease the amount of microwave energy interactive material available for heating, browning, and/or crisping the surface of the food item. Thus, the relative amounts of microwave energy interactive areas and microwave energy transparent areas may be balanced to attain the desired overall heating characteristics for the particular food item.

As another example, one or more portions of a susceptor may be designed to be microwave energy inactive to ensure that the microwave energy is focused efficiently on the areas to be heated, browned, and/or crisped, rather than being lost to portions of the food item not intended to be browned and/or crisped or to the heating environment. Additionally or alternatively, it may be beneficial to create one or more discontinuities or inactive regions to prevent overheating or charring of the food item and/or the construct including the susceptor.

As still another example, a susceptor may incorporate one or more "fuse" elements that limit the propagation of cracks in the susceptor, and thereby control overheating, in areas of the susceptor where heat transfer to the food is low and the susceptor might tend to become too hot. The size and shape of the fuses may be varied as needed. Examples of susceptors including such fuses are provided, for example, in U.S. Pat. No. 5,412,187, U.S. Pat. No. 5,530,231, U.S. Patent Application Publication No. US 2008/0035634A1, published Feb. 14, 2008, and PCT Application Publication No. WO 2007/127371, published Nov. 8, 2007, each of which is incorporated by reference herein in its entirety.

The blanks according to the present invention can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks.

In accordance with the exemplary embodiments, the blanks and/or other constructs may be constructed of paperboard of a caliper such that it is heavier and more rigid than ordinary paper. The blanks can also be constructed of other materials, such as cardboard, hard paper, or any other material having properties suitable for enabling the carton package to function at least generally as described above.

The foregoing description illustrates and describes various embodiments of the present disclosure. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, and alterations, etc., of the above-described embodiments. Additionally, the disclosure shows and describes only selected embodiments, but various other combinations, modifications, and environments are contemplated and are within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments without departing from the scope of the disclosure.

What is claimed is:

1. A container for heating a plurality of food items with microwave energy, the container comprising:

a tray comprising a sidewall extending at least partially around an interior of the tray;

an insert disposed at least partially in the interior of the tray, the insert comprising a plurality of lateral ribs, a plurality of longitudinal ribs, and a central panel extending over at least one lateral rib of the plurality of lateral ribs and at least one longitudinal rib of the plurality of longitudinal ribs, wherein the central panel contacts the at least one lateral rib and the at least one longitudinal rib along respective portions of respective top edges of the at least one lateral rib and the at least one longitudinal rib, and the portions of the top edges of the at least one lateral rib and the at least one longitudinal rib are recessed to at least partially accommodate the central panel; and a plurality of receptacles at least partially defined by the insert, each receptacle of the plurality of receptacles being for at least partially receiving at least one food item of the plurality of food items;

wherein each lateral rib of the plurality of lateral ribs engages each longitudinal rib of the plurality of longitudinal ribs to at least partially form the plurality of receptacles.

2. The container of claim 1, wherein a microwave energy interactive element extends along each of the receptacles of the plurality of receptacles.

3. The container of claim 1, wherein each of the receptacles of the plurality of receptacles comprises a plurality of sides defined by the insert, and each side of the plurality of sides defined by the insert comprises a microwave energy interactive material.

4. The container of claim 3, wherein the tray further comprises a bottom wall comprising a microwave energy interactive material.

5. The container of claim 3, wherein a lateral rib of the plurality of lateral ribs intersects with a longitudinal rib of the plurality of longitudinal ribs to at least partially form multiple receptacles of the plurality of receptacles.

6. The container of claim 5, wherein each of the lateral rib and the longitudinal rib defines a side of the plurality of sides for each receptacle of the multiple receptacles.

7. The container of claim 6, wherein each of the lateral rib and the longitudinal rib comprises two faces each having the microwave energy interactive material disposed thereon.

8. The container of claim 1, wherein each of the lateral ribs and the longitudinal ribs defines a side of the plurality of sides for respective receptacles of the plurality of receptacles, and each of the lateral ribs and the longitudinal ribs comprises two faces each having the microwave energy interactive material disposed thereon.

9. The container of claim 1, wherein a lateral rib of the plurality of lateral ribs intersects with a longitudinal rib of the plurality of longitudinal ribs to at least partially form multiple receptacles of the plurality of receptacles.

10. The container of claim 9, wherein each of the lateral rib and the longitudinal rib defines at least one side of each receptacle of the multiple receptacles.

11. The container of claim 9, wherein the lateral rib comprises a first notch and the longitudinal rib comprises a second notch, the first notch and second notch engaging one another at an intersection of the lateral rib and the longitudinal rib.

12. The container of claim 11, wherein the top edge of the lateral rib is generally coplanar with the top edge of the longitudinal rib.

13. The container of claim 12, wherein one of the first notch and the second notch is in communication with the top edge of the respective lateral rib and longitudinal rib, and one of the first notch and the second notch is in communication with a bottom edge of the respective lateral rib and longitudinal rib.

14. The container of claim 11, wherein each of the first notch and the second notch comprises a tapered portion extending from an edge of the respective lateral rib and longitudinal rib and a slit portion extending from the respective tapered portion.

15. The container of claim 1, wherein each receptacle of the plurality of receptacles comprises a plurality of sides defined by the insert, and each side of the plurality of sides defined by the insert for each receptacle comprises a respective portion of a respective one of the plurality of lateral ribs and the plurality of longitudinal ribs.

16. The container of claim 1, wherein each lateral rib of the plurality of lateral ribs comprises a plurality of first notches and each longitudinal rib of the plurality of longitudinal ribs comprises a plurality of second notches, and each first notch engages a respective second notch.

17. The container of claim 1, wherein the central panel is at least partially attached to the top edge of each of the at least one lateral rib and the at least one longitudinal rib.

18. The container of claim 1, wherein the central panel comprises a recess for holding a secondary food item, and the top edges of the at least one lateral rib and the at least one longitudinal rib are further recessed to at least partially accommodate the recess in the central panel.

19. The container of claim 1, wherein the central panel comprises a recess for receiving a secondary container holding a secondary food item.

20. The container of claim 1, wherein the plurality of receptacles is a first plurality of receptacles, and the central panel extends over a second plurality of receptacles at least partially defined by the insert.

21. The container of claim 20, wherein the second plurality of receptacles comprises four receptacles at least partially covered by the central panel, and the central panel engages three lateral ribs of the plurality of lateral ribs and three longitudinal ribs of the plurality of longitudinal ribs.

22. An insert for being disposed in an interior of a tray to form a container for heating a plurality of food items with microwave energy, the insert comprising:

a plurality of lateral ribs;

a plurality of longitudinal ribs, each lateral rib of the plurality of lateral ribs engaging each longitudinal rib of the plurality of longitudinal ribs;

a plurality of receptacles at least partially defined by at least one of the lateral ribs of the plurality of lateral ribs and at least one of the longitudinal ribs of the plurality of longitudinal ribs, each receptacle of the plurality of receptacles being for receiving at least one food item of the plurality of food items; and a central panel extending over at least one lateral rib of the plurality of lateral ribs and at least one longitudinal rib of the plurality of longitudinal ribs, wherein the central panel contacts the at least one lateral rib and the at least one longitudinal rib along respective portions of respective top edges of the at least one lateral rib and the at least one longitudinal rib, and the portions of the top edges of the at least one lateral rib and the at least one longitudinal rib are recessed to at least partially accommodate the central panel.

23. The insert of claim 22, wherein a microwave energy interactive element extends along each of the receptacles of the plurality of receptacles.

24. The insert of claim 22, wherein each of the receptacles of the plurality of receptacles comprises a plurality of sides defined by the insert, and each side of the plurality of sides defined by the insert comprises a microwave energy interactive material.

25. The insert of claim 24, wherein each of the lateral ribs and the longitudinal ribs defines a side of the plurality of sides for respective receptacles of the plurality of receptacles.

26. The insert of claim 25, wherein each of the lateral ribs and the longitudinal ribs comprises two faces each having the microwave energy interactive material disposed thereon.

27. The insert of claim 22, wherein each receptacle of the plurality of receptacles comprises a plurality of sides defined by the insert, and each side of the plurality of sides defined by the insert for each receptacle comprises a respective portion of a respective one of the plurality of lateral ribs and the plurality of longitudinal ribs.

28. The insert of claim 22, wherein each lateral rib of the plurality of lateral ribs comprises a plurality of first notches and each longitudinal rib of the plurality of longitudinal ribs comprises a plurality of second notches, and each first notch engages a respective second notch.

29. The insert of claim 28, wherein for each of the lateral ribs of the plurality of lateral ribs, each first notch of the plurality of first notches is in communication with a first edge of the respective lateral rib, and for each of the longitudinal ribs of the plurality of longitudinal ribs each second notch of the plurality of second notches is in communication with a second edge of the respective longitudinal rib.

30. The insert of claim 29, wherein the first edge of each of the lateral ribs is a bottom edge of the respective lateral rib, and the second edge of each of the longitudinal ribs is the top edge of the respective longitudinal rib.

31. The insert of claim 28, wherein each of the first notches and the second notches comprises a tapered portion extending from an edge of the respective lateral ribs and longitudinal ribs and a slit portion extending from the respective tapered portion.

32. The insert of claim 22, wherein the central panel is at least partially attached to the top edge of each of the at least one lateral rib and the at least one longitudinal rib.

33. The insert of claim 22, wherein the central panel comprises a recess for holding a secondary food item.

34. The insert of claim 22, wherein the central panel comprises a recess for receiving a secondary container holding a secondary food item.

35. The insert of claim 22, wherein the plurality of receptacles is a first plurality of receptacles, and the central panel extends over a second plurality of receptacles at least partially defined by the insert.

36. The insert of claim 35, wherein the second plurality of receptacles comprises four receptacles at least partially covered by the central panel, and the central panel engages three lateral ribs of the plurality of lateral ribs and three longitudinal ribs of the plurality of longitudinal ribs.

37. A method of forming a package, comprising:

obtaining a tray comprising a sidewall extending at least partially around an interior of the tray;

forming the insert by engaging each lateral rib of a plurality of lateral ribs with each longitudinal rib of a plurality of longitudinal ribs to at least partially form a plurality of receptacles, wherein the forming the insert further comprises positioning a central panel to extend over at least one lateral rib of the plurality of lateral ribs and at least one longitudinal rib of the plurality of longitudinal ribs, the central panel contacting the at least one lateral rib and the at least one longitudinal rib along respective portions of respective top edges of the at least one lateral rib and the at least one longitudinal rib, and the portions of the top edges of the at least one lateral rib and the at least one longitudinal rib being recessed to at least partially accommodate the central panel;

at least partially forming a container by positioning the insert at least partially in the interior of the tray; and inserting a plurality of food items into the container by positioning at least one food item of the plurality of food items at least partially into each receptacle of the plurality of receptacles.

38. The method of claim 37, wherein a microwave energy interactive element extends along each of the receptacles of the plurality of receptacles.

39. The method of claim 37, wherein each of the lateral ribs of the plurality of lateral ribs comprises a first notch and each of the longitudinal ribs of the plurality of longitudinal ribs comprises a second notch, and the engaging each lateral rib of the plurality of lateral ribs with each longitudinal rib of the plurality of longitudinal ribs comprises engaging the first notch and second notch with one another for each of the lateral ribs and for each of the longitudinal ribs.

40. The method of claim 37, wherein the forming the insert further comprises attaching the central panel to the top edge of each of the at least one lateral rib and the at least one longitudinal rib.

41. The method of claim 37, wherein the central panel comprises a recess, and the method further comprises disposing a secondary food item in the recess.

* * * * *